US010595699B2

(12) United States Patent
Chang

(10) Patent No.: US 10,595,699 B2
(45) Date of Patent: Mar. 24, 2020

(54) SCRAPER

(71) Applicant: Jason Chang, Taichung (TW)

(72) Inventor: Jason Chang, Taichung (TW)

( * ) Notice: Subject to any disclaimer, the term of this patent is extended or adjusted under 35 U.S.C. 154(b) by 395 days.

(21) Appl. No.: 15/595,969

(22) Filed: May 16, 2017

(65) Prior Publication Data

US 2018/0333035 A1 Nov. 22, 2018

(51) Int. Cl.

| | |
|---|---|
| ***A47L 13/022*** | (2006.01) |
| ***A47L 13/08*** | (2006.01) |
| ***B44D 3/16*** | (2006.01) |
| ***B25G 1/10*** | (2006.01) |

(52) U.S. Cl.

CPC ..... *A47L 13/022* (2013.01); *A47L 13/08* (2013.01); *B25G 1/10* (2013.01); *B44D 3/164* (2013.01)

(58) Field of Classification Search

CPC ..... A47L 13/022; A47L 13/08; B44D 3/16; B44D 3/162; B44D 3/164; B25G 1/00; B25G 1/10; B25G 3/34; B25G 3/36; B25G 1/08; E04F 21/06; E04F 21/16; E04F 21/32; E04F 21/161; E04F 21/163; Y10T 16/498

USPC ..... 15/143.1, 236.01; 76/104.1, 106; 30/169, 340, 344

See application file for complete search history.

(56) References Cited

U.S. PATENT DOCUMENTS 274,318 A * 3/1883 Hallstrom ..... B26B 3/02 76/106
656,757 A * 8/1900 Hirsch ..... B21D 53/645 76/104.1
2,410,572 A * 11/1946 Echikson ..... B25G 3/26 30/344
3,018,497 A * 1/1962 Echikson ..... B25G 3/26 15/143.1

* cited by examiner

*Primary Examiner* — Laura C Guidotti

(57) ABSTRACT

A scraper includes two shells juxtaposed and soldered together, a blade combined with the two shells, and a connecting member combined with the two shells. Each of the two shells has a receiving space, a plurality of first soldering portions, a first opening, a first slot, a second soldering portion, and a third soldering portion. The blade has an operation portion and a first mounting portion. The first mounting portion extends through the first opening into the receiving space and has a fourth soldering portion combined with the second soldering portions of the two shells by soldering. The connecting member is located in the receiving space and has a second slot aligning with the first slot. The connecting member has two ends each provided with a fifth soldering portion combined with the third soldering portion by soldering.

9 Claims, 10 Drawing Sheets

SCRAPER

BACKGROUND OF THE INVENTION

1. Field of the Invention

The present invention relates to a scraper that is used to scrape a paint or an attachment on the face of a workpiece.

2. Description of the Related Art

A conventional scraper, as disclosed in U.S. Pat. No. 5,008,970, comprises a blade 1, a handle 2 and two covers 5. A plurality of holes 11 are formed in the rear end of the blade 1 so that the blade 1 and the front portion 22 of the handle 2 are rigidly molded together. The handle 2 substantially comprises a plate 20 and an outer perimeter wall 21 formed on an upper surface and a lower surface thereof. Two holes 23, 24 and an opening 25 are formed in the plate 20 in which the opening 25 in the rear end of the plate 20 is preferably larger in diameter than the two holes 23, 24. A perimeter recess 26 is formed in the upper and inner surface of each perimeter wall 21. The two covers 5 are substantially identical in shape and each has a shape corresponding to the recess 26 of the perimeter wall 21. The recess 26 and the covers 5 are arranged such that the covers 5 are rested in the recess 26 in order to form a smooth outer surface for the handle 2. Two retainers 52, 53 and a clamping device 54 are provided on the cover 5 and are arranged in accordance with the holes 23, 24 and the opening 25 of the plate 20 of the handle 2. However, the covers 5 are made of plastic material, so that the two retainers 52, 53 and the clamping device 54 easily become loosened due to rubbing during a long period of time. In addition, the front portion 22 of the handle 2 has two projections locked in the holes 11 of the blade 1. The handle 2 is made of plastic material, and the blade 1 is made of metal, so that the projections of the front portion 22 of the handle 2 are easily detached from the holes 11 of the blade 1 during a long period of time.

SUMMARY OF THE INVENTION

The present invention is to mitigate and/or obviate the disadvantage of the conventional scraper.

In accordance with the present invention, there is provided a scraper comprising two shells juxtaposed to each other, a blade combined with the two shells, and a connecting member combined with the two shells. Each of the two shells is made of metal and formed by stamping. Each of the two shells has a receiving space, a plurality of first soldering portions, a first opening and a first slot. The first opening is connected to the receiving space and has a second soldering portion. The first slot has a third soldering portion. The first soldering portions of the two shells are juxtaposed and combined together by soldering so that the two shells are combined integrally. The blade is made of material the same as that of each of the two shells and has an operation portion and a first mounting portion. The first mounting portion extends through the first opening into the receiving space and has a fourth soldering portion combined with the second soldering portions of the two shells by soldering. The connecting member is located in the receiving space and has a second slot aligning with the first slot. The connecting member has two ends each provided with a fifth soldering portion combined with the third soldering portion by soldering. The first soldering portions of the two shells are worked by polishing after the first soldering portions are soldered, and the two shells have a smooth face at the first soldering portions. The second soldering portions of the two shells and the fourth soldering portion of the blade are soldered and form two solders which are arranged on an intersection of the two shells and the blade.

Further benefits and advantages of the present invention will become apparent after a careful reading of the detailed description with appropriate reference to the accompanying drawings.

DETAILED DESCRIPTION OF THE INVENTION

Figure 1:
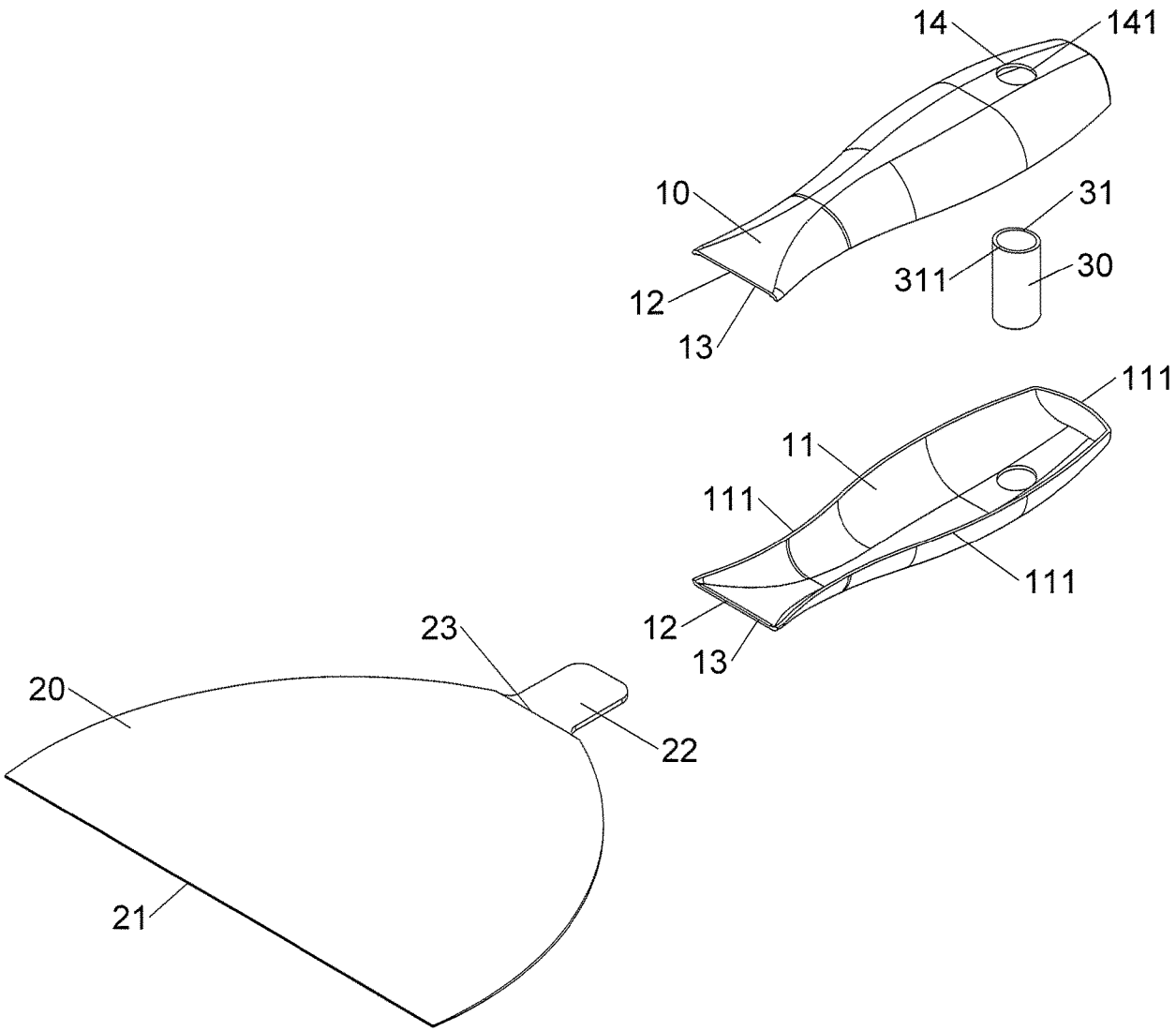
FIG. 1 is an exploded perspective view of a scraper in accordance with the preferred embodiment of the present invention.
Figure 2:
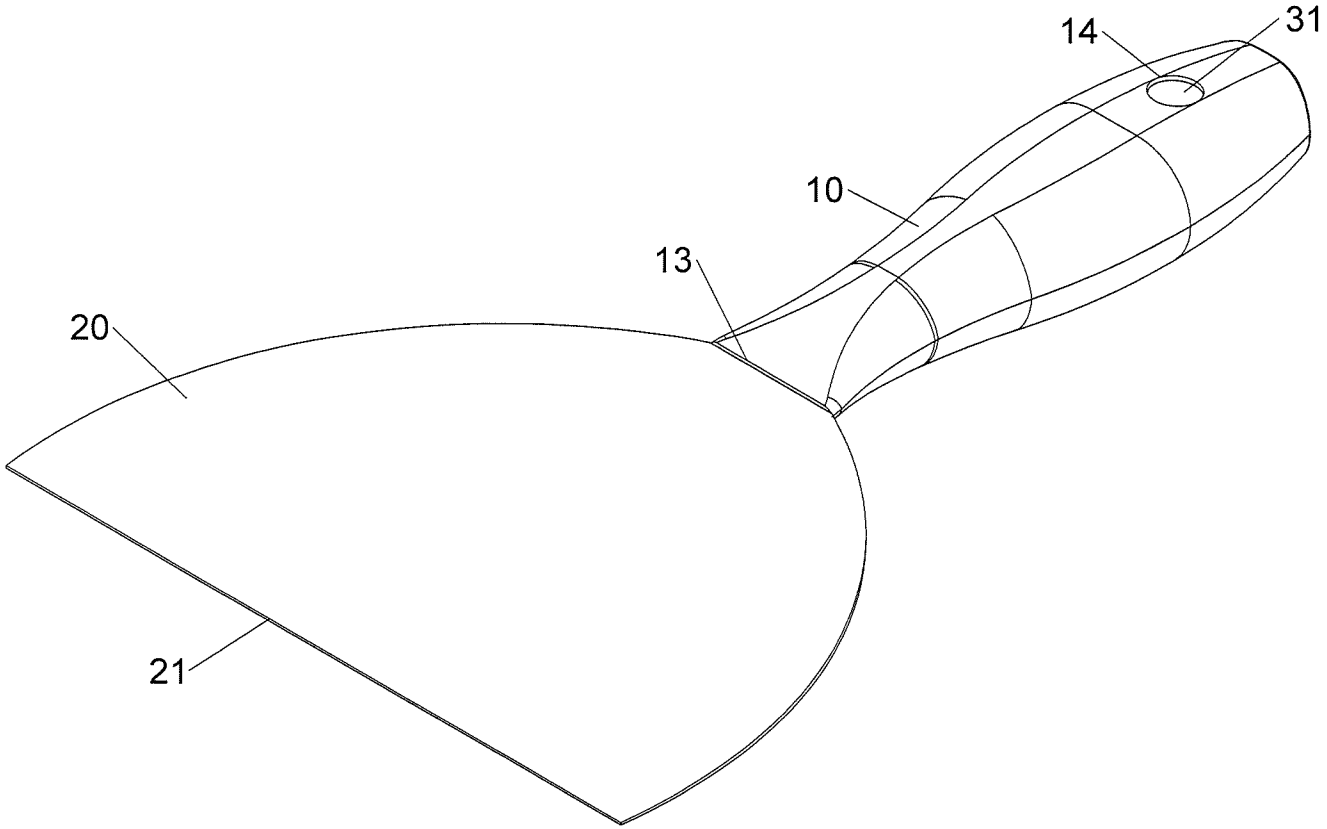
FIG. 2 is a perspective assembly view of the scraper in accordance with the preferred embodiment of the present invention.
Figure 5:
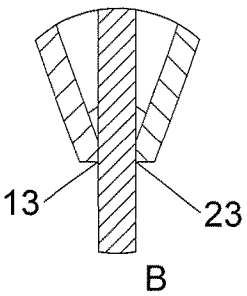
FIG. 5 is a locally enlarged view of the scraper taken along circle B as shown in FIG. 4.
Figure 4:
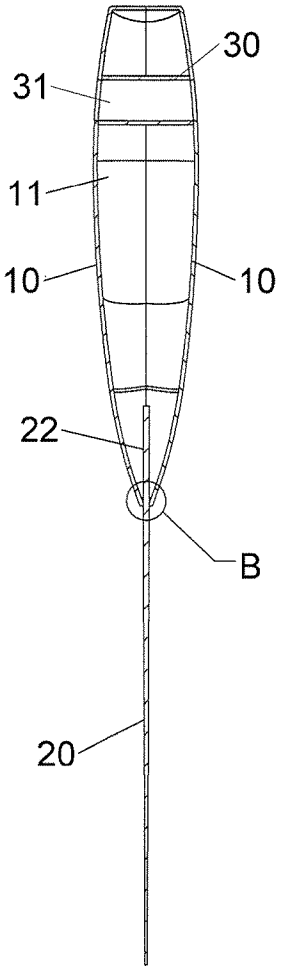
FIG. 4 is a cross-sectional view of the scraper taken along line 4-4 as shown in FIG. 3.
Figure 3:
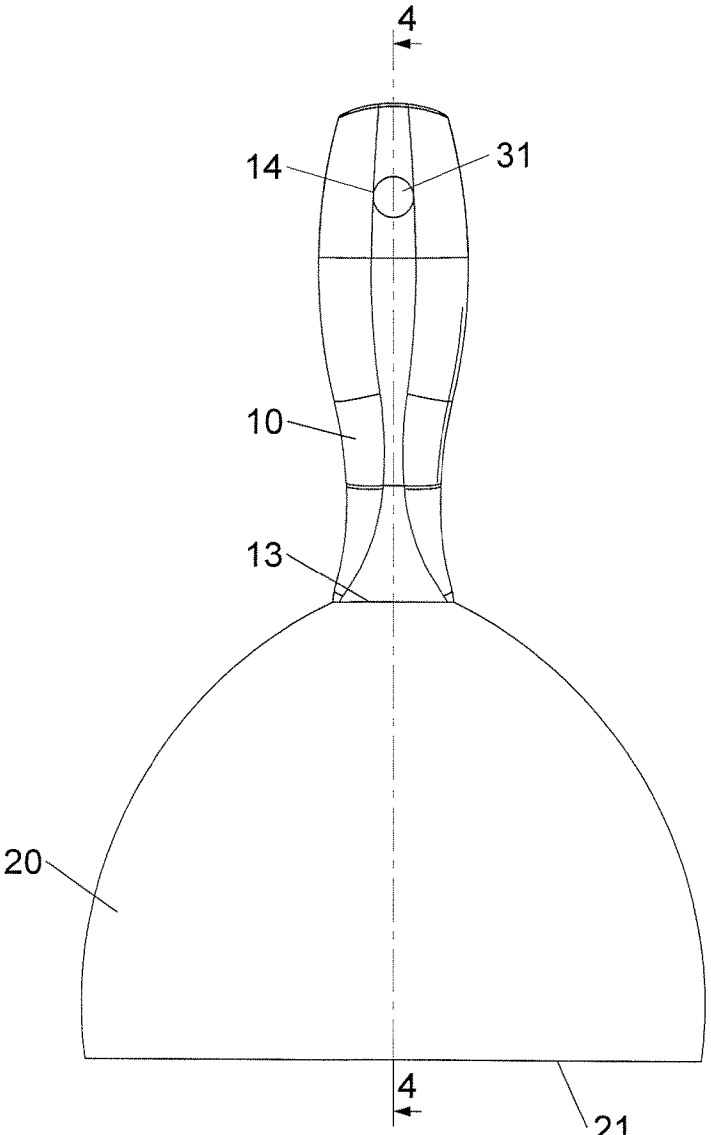
FIG. 3 is a top view of the scraper as shown in FIG. 2.

Referring to the drawings and initially to FIGS. 1-5, a scraper in accordance with the preferred embodiment of the present invention comprises two shells 10 juxtaposed to each other, a blade 20 combined with the two shells 10, and a connecting member 30 combined with the two shells 10.

Each of the two shells 10 is made of metal and formed by stamping. Each of the two shells 10 has a receiving space 11, a plurality of first soldering portions 111, a first opening 12 and a first slot 14. The first opening 12 is connected to the receiving space 11 and has a second soldering portion 13. The first slot 14 has a circular shape and has a third soldering portion 141. The first soldering portions 111 of the two shells 10 are juxtaposed and combined together by soldering so that the two shells 10 are combined integrally.

The blade 20 is made of material the same as that of each of the two shells 10 and has an operation portion 21 and a first mounting portion 22. The first mounting portion 22 extends through the first opening 12 into the receiving space 11 and has a fourth soldering portion 23 combined with the second soldering portions 13 of the two shells 10 by soldering.

The connecting member 30 is located in the receiving space 11 and has a second slot 31 aligning with the first slot 14. The connecting member 30 has two ends each provided with a fifth soldering portion 311 combined with the third soldering portion 141 by soldering. Preferably, the connecting member 30 has a cylindrical shape, and the second slot 31 is used for hanging.

Figure 6:
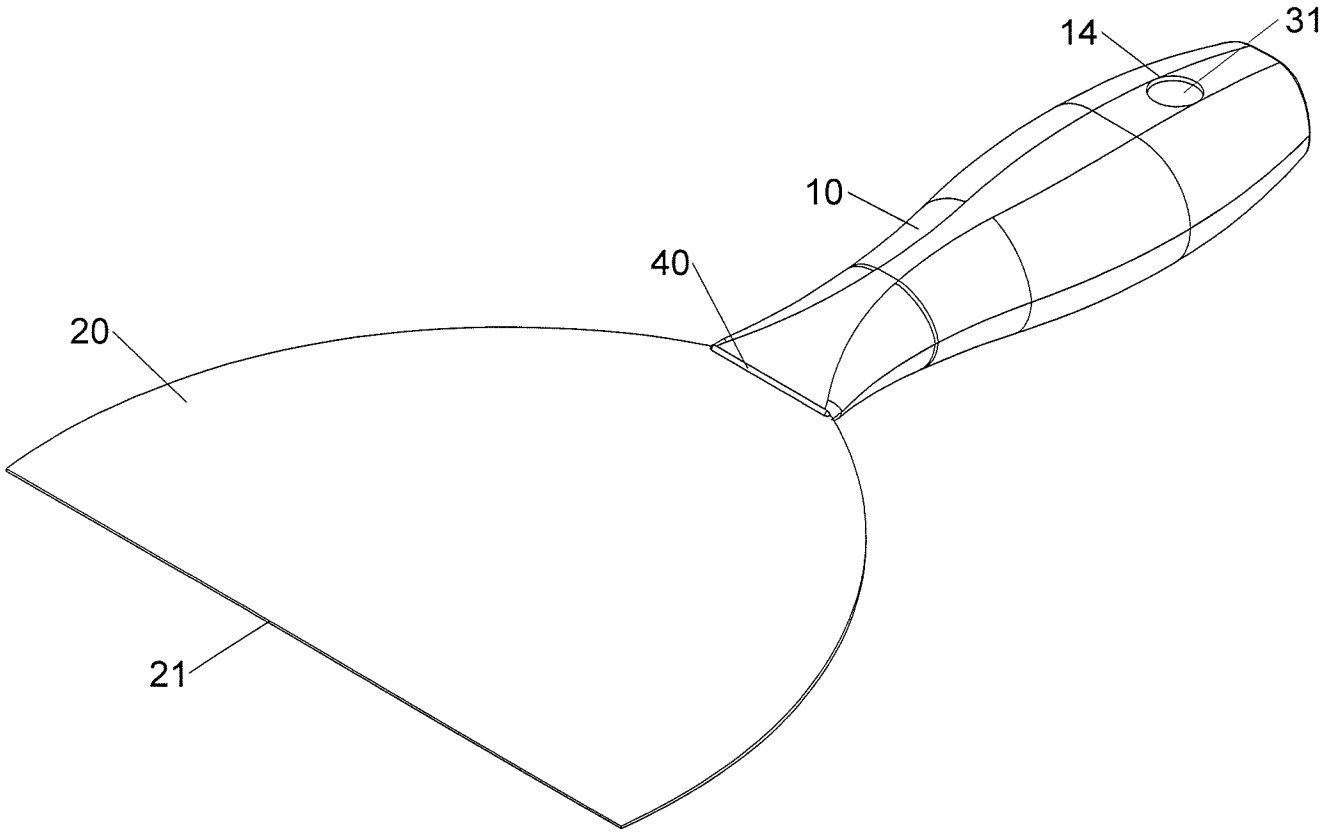
FIG. 6 is a perspective view showing the scraper being soldered.
Figure 7:
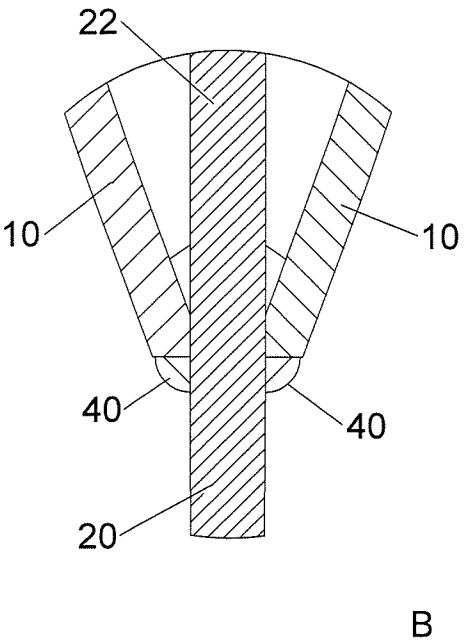
FIG. 7 is a locally enlarged cross-sectional view of the scraper as shown in FIG. 6.

Referring to FIGS. 6 and 7, the first soldering portions 111 of the two shells 10 are worked by polishing after the first soldering portions 111 are soldered, and the two shells 10 have a smooth face at the first soldering portions 111. The second soldering portions 13 of the two shells 10 and the fourth soldering portion 23 of the blade 20 are soldered and form two solders 40 which are arranged on an intersection of the two shells 10 and the blade 20.

Figure 8:
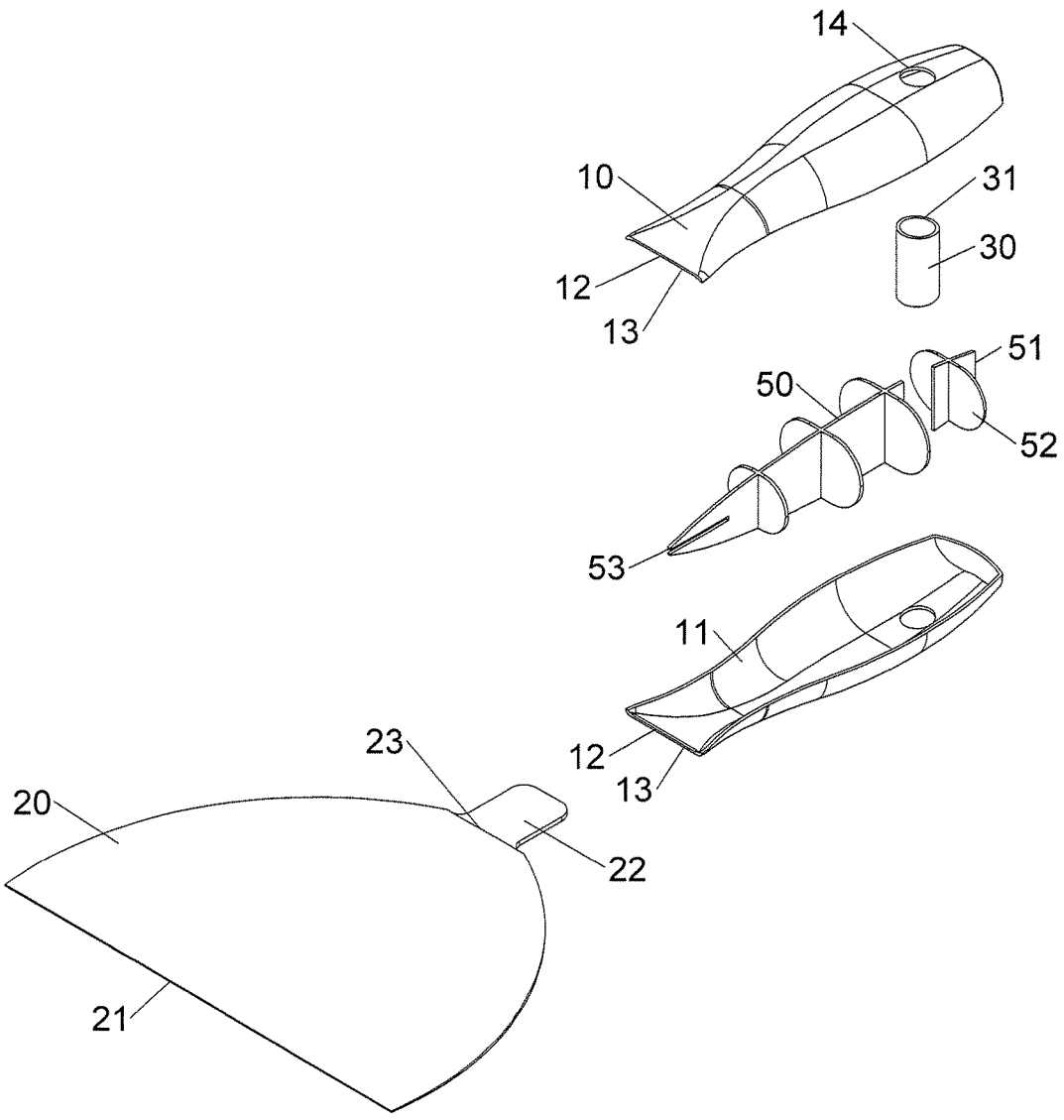
FIG. 8 is an exploded perspective view of a scraper in accordance with the second preferred embodiment of the present invention.
Figure 9:
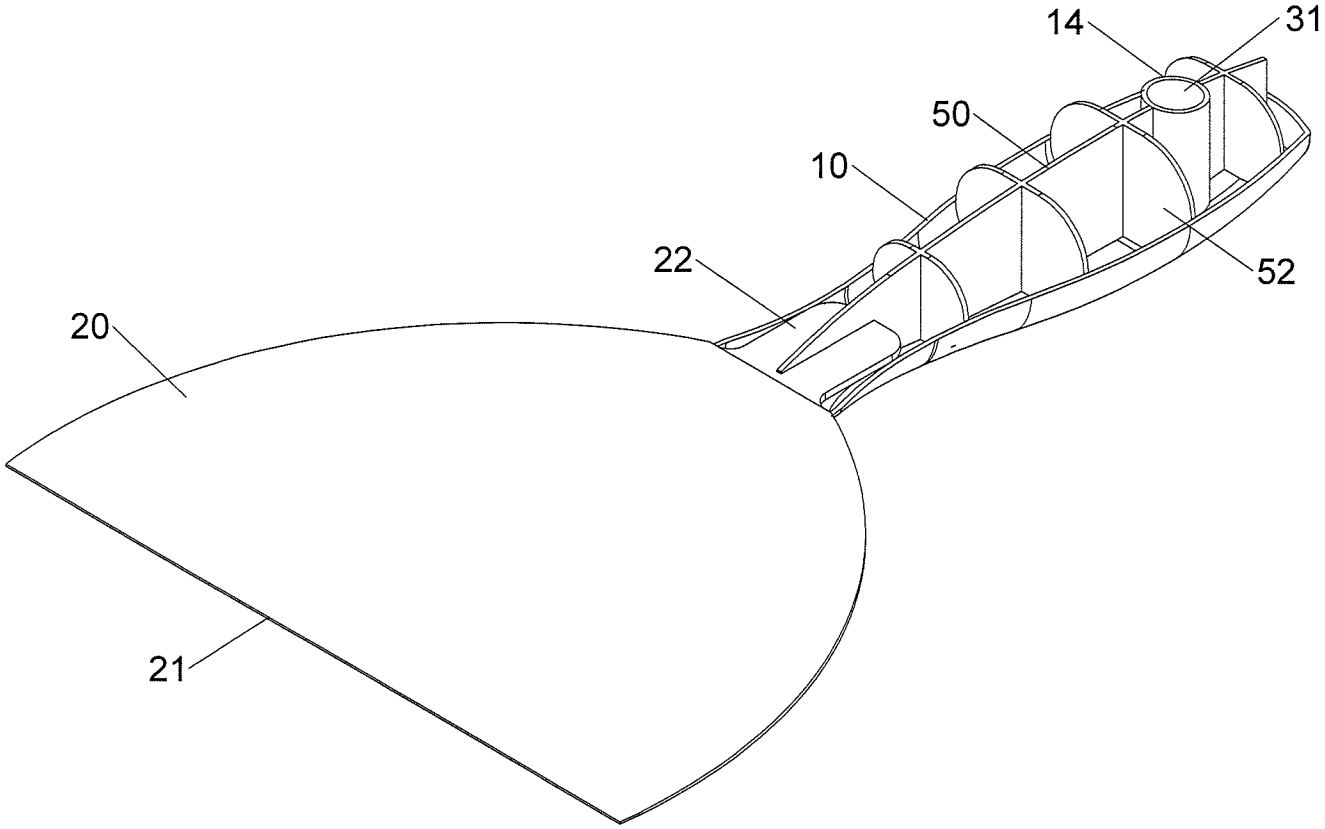
FIG. 9 is a partially perspective assembly view of the scraper as shown in FIG. 8.

Referring to FIGS. 8 and 9, the scraper further comprises at least one support member 50 located in the receiving space 11 and resting on an inner face of the receiving space 11, so that the at least one support member 50 is not movable in the receiving space 11. The at least one support member 50 includes an upright portion 51 and a plurality of transverse portions 52 arranged on the upright portion 51. The at least one support member 50 has a second mounting portion 53 mounted with the first mounting portion 22.

Figure 10:
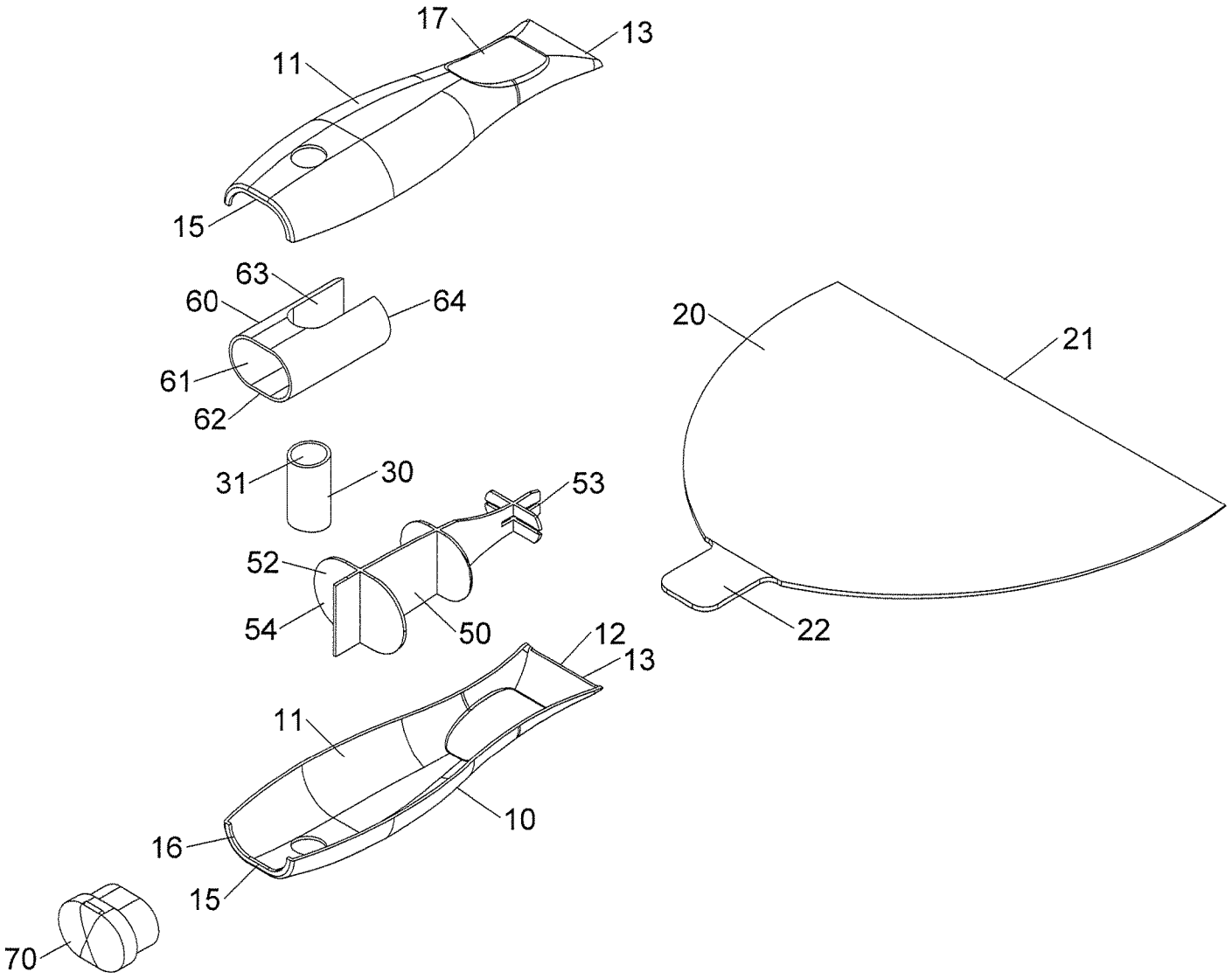
FIG. 10 is an exploded perspective view of a scraper in accordance with the third preferred embodiment of the present invention.
Figure 11:
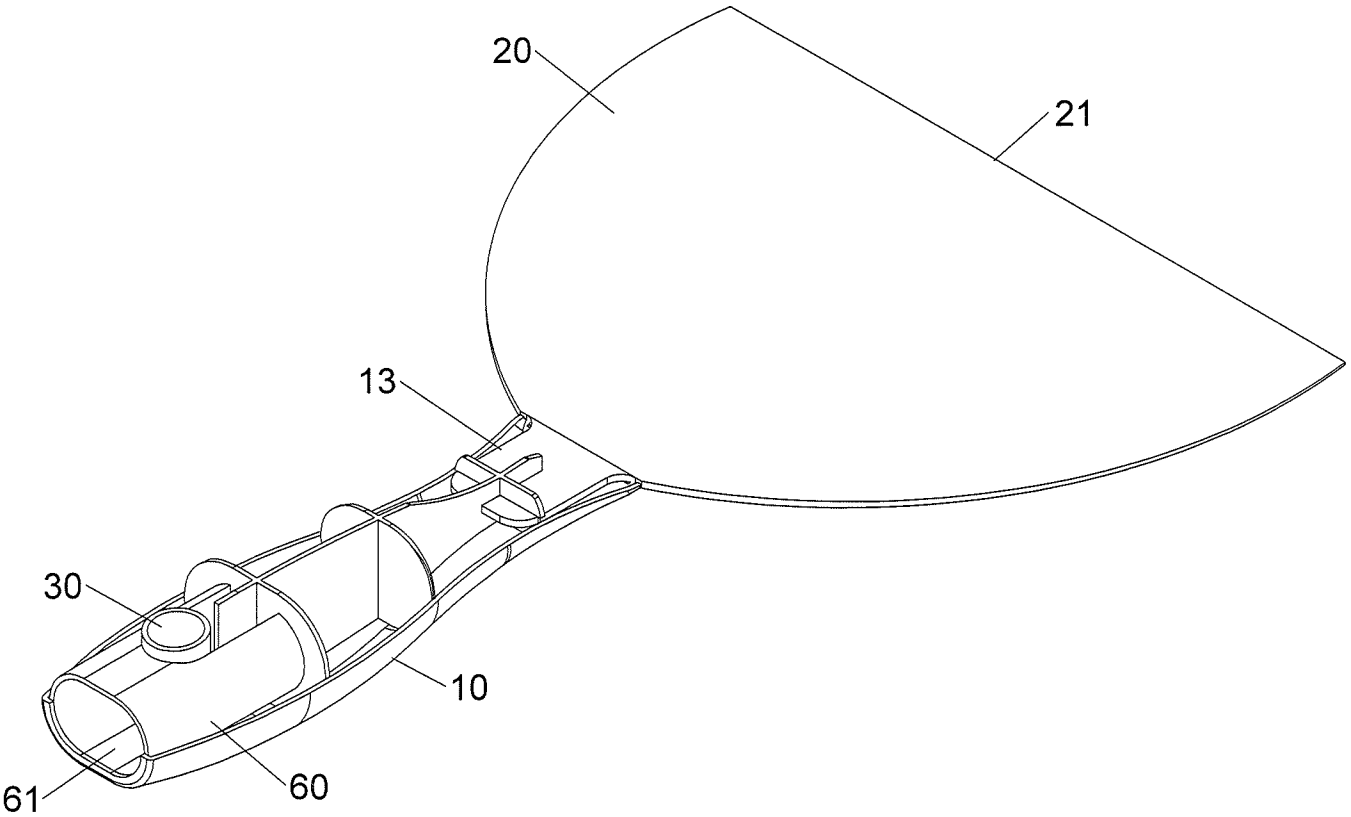
FIG. 11 is a partially perspective assembly view of the scraper as shown in FIG. 10.
Figure 12:
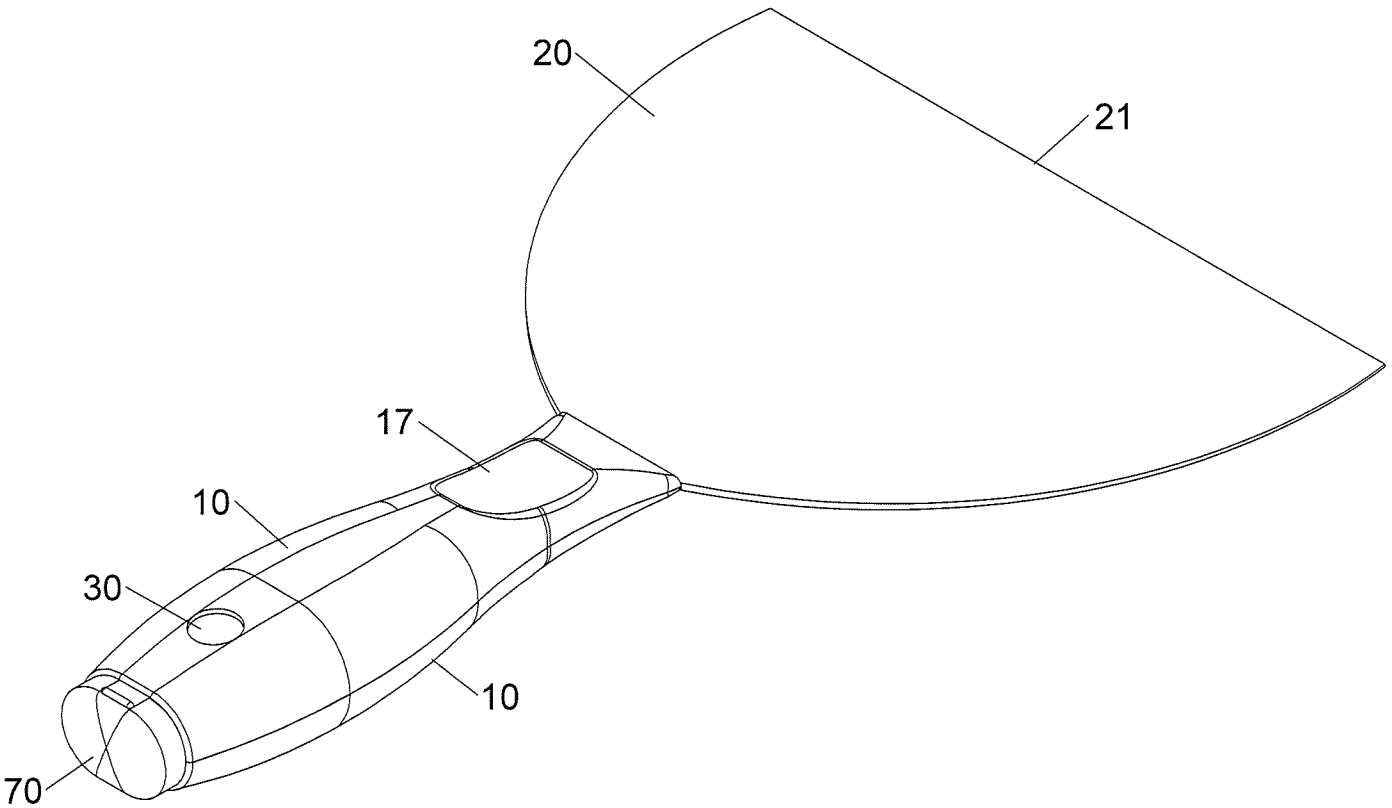
FIG. 12 is a perspective assembly view of the scraper as shown in FIG. 10.

Referring to FIGS. 10-12, each of the two shells 10 has a second opening 15 distant from the first opening 12. The second opening 15 has a first resting edge 16. The at least one support member 50 has a second resting edge 54. The scraper further comprises a receiving member 60 mounted in the receiving space 11 and having a first receiving groove 61 and a second receiving groove 63. The first receiving groove 61 receives a hand tool, such as a nail puller, a screwdriver tip and the like, and has a third resting edge 62 abutting the first resting edge 16. The second receiving groove 63 allows passage of the connecting member 30. The receiving member 60 has a fourth resting edge 64 abutting the second resting edge 54. The scraper further comprises a cap 70 received in the second opening 15 and the first receiving groove 61 to close the second opening 15. The cap 70 partially projects from the two shells 10. Each of the two shells 10 has a concave abutting portion 17 allowing pressing of a user's thumb. The abutting portion is close to the first opening 12.

In another preferred embodiment of the present invention, the receiving space 11 of each of the two shells 10 has the maximum width and the maximum height relative to the first slot 14, so that the connecting member 30 is not movable in the receiving space 11, and the connecting member 30 and the two shells 10 do not need soldering.

In another preferred embodiment of the present invention, the at least one support member 50 has a receiving portion receiving the connecting member 30, so that the connecting member 30 is limited by the at least one support member 50 and is not movable in the receiving space 11, and the connecting member 30 and the two shells 10 do not need soldering.

In another preferred embodiment of the present invention, the connecting member 30 and the at least one support member 50 are formed integrally and are directly received in the receiving space 11.

In another preferred embodiment of the present invention, each of the two shells 10 has streaks to facilitate the user holding the two shells 10, and to enhance the appearance of the two shells 10.

Accordingly, the scraper has the following advantages.

1. The two shells 10 are combined to form a handle, and each of the two shells 10 is a thin shell, so that the scraper has a light weight.

2. The first soldering portions 111 are soldered so that the two shells 10 are combined integrally, and the soldering position of the two shells 10 is worked by polishing so that the two shells 10 have a smooth face and an enhanced appearance.

3. Each of the two shells 10 is made of metal and will not be contaminated by oil or dirt easily.

4. The at least one support member 50 is located in the receiving space 11 to enhance the strength of the two shells 10.

5. The at least one support member 50 has a second mounting portion 53 mounted with the first mounting portion 22, so that the two shells 10, the blade 20 and the at least one support member 50 have a better assembly structure.

6. The first receiving groove 61 of the receiving member 60 receives a hand tool, such as a nail puller or a screwdriver tip, so as to remove nails or screws on the wall.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A scraper comprising:

two shells juxtaposed to each other;

a blade combined with the two shells;

a connecting member combined with the two shells;

at least one support member;

a receiving member; and a cap;

wherein:

each of the two shells is made of metal and formed by stamping;

each of the two shells has a receiving space, a plurality of first soldering portions, a first opening and a first slot;

the first opening is connected to the receiving space and has a second soldering portion;

the first slot has a third soldering portion;

the first soldering portions of the two shells are juxtaposed and combined together by soldering so that the two shells are combined integrally;

the blade is made of material the same as that of each of the two shells and has an operation portion and a first mounting portion;

the first mounting portion extends through the first opening into the receiving space and has a fourth soldering portion combined with the second soldering portions of the two shells by soldering;

the connecting member is located in the receiving space and has a second slot aligning with the first slot;

the connecting member has two ends each provided with a fifth soldering portion combined with the third soldering portion by soldering;

the first soldering portions of the two shells are worked by polishing after the first soldering portions are soldered, and the two shells have a smooth face at the first soldering portions;

the second soldering portions of the two shells and the fourth soldering portion of the blade are soldered and form two solders which are arranged on an intersection of the two shells and the blade;

the at least one support member is located in the receiving space and rests on an inner face of the receiving space, so that the at least one support member is not movable in the receiving space; each of the two shells has a second opening distant from the first opening, the second opening has a first resting edge, the at least one support member has a second resting edge; the receiving member is mounted in the receiving space, and has a first receiving groove and a second receiving groove; the first receiving groove receives a hand tool and has a third resting edge abutting the first resting edge; the second receiving groove allows passage of the connecting member; the receiving member has a fourth resting edge abutting the second resting edge; the cap is received in the second opening and the first receiving groove to close the second opening, and the cap partially projects from the two shells.

2. The scraper in accordance with claim 1, wherein the first slot has a circular shape, and the connecting member has a cylindrical shape.

3. The scraper in accordance with claim 1, wherein the second slot is used for hanging.

4. The scraper in accordance with claim 1, wherein the at least one support member includes an upright portion and a plurality of transverse portions arranged on the upright portion, and the at least one support member has a second mounting portion mounted with the first mounting portion.

5. The scraper in accordance with claim 1, wherein each of the two shells has a concave abutting portion allowing pressing of a user's thumb, and the abutting portion is close to the first opening.

6. The scraper in accordance with claim 1, wherein the receiving space of each of the two shells has the maximum width and the maximum height relative to the first slot, so that the connecting member is not movable in the receiving space.

7. The scraper in accordance with claim 1, wherein the at least one support member has a receiving portion receiving the connecting member, so that the connecting member is limited by the at least one support member and is not movable in the receiving space.

8. The scraper in accordance with claim 1, wherein the connecting member and the at least one support member are formed integrally and are directly received in the receiving space.

9. The scraper in accordance with claim 1, wherein each of the two shells has streaks.

* * * * *